US010165923B2

(12) United States Patent
Mitchell

(10) Patent No.: US 10,165,923 B2
(45) Date of Patent: Jan. 1, 2019

(54) FLOOR SQUEEGEE

(71) Applicant: PRO PAINT GEAR INC., Brighton (CA)

(72) Inventor: Jack A. Mitchell, Brighton (CA)

(73) Assignee: PRO PAINT GEAR INC., Brighton, Ontario (CA)

( * ) Notice: Subject to any disclaimer, the term of this patent is extended or adjusted under 35 U.S.C. 154(b) by 25 days.

(21) Appl. No.: 15/504,206

(22) PCT Filed: Dec. 5, 2016

(86) PCT No.: PCT/CA2016/051425

§ 371 (c)(1),
(2) Date: Feb. 15, 2017

(87) PCT Pub. No.: WO2017/096471

PCT Pub. Date: Jun. 15, 2017

(65) Prior Publication Data

US 2018/0103818 A1 Apr. 19, 2018

Related U.S. Application Data

(60) Provisional application No. 62/264,588, filed on Dec. 8, 2015.

(51) Int. Cl.

| | |
|---|---|
| ***A47L 13/11*** | (2006.01) |
| ***B05C 17/10*** | (2006.01) |
| ***E04F 21/24*** | (2006.01) |

(52) U.S. Cl.

CPC ..... *A47L 13/11* (2013.01); *B05C 17/10* (2013.01); *E04F 21/241* (2013.01)

(58) Field of Classification Search

CPC .. A47L 13/11; A47L 1/06; B05C 17/10; E04F 21/241

(Continued)

(56) References Cited

U.S. PATENT DOCUMENTS

| | | | |
|---|---|---|---|
| 2,197,927 A | 4/1940 | Ehrlich | |
| 2,230,583 A | 2/1941 | Borden | |

(Continued)

FOREIGN PATENT DOCUMENTS

| | | | |
|---|---|---|---|
| EP | 0451027 A1 * | 10/1991 | ..... A47L 13/11 |
| GB | 919745 A * | 2/1963 | ..... A47L 1/06 |
| JP | 5317311 | 10/2013 | |

OTHER PUBLICATIONS

Computer generated English translation of EP 0451027 A1, Pourtau et al., Oct. 1991.*

(Continued)

*Primary Examiner* — Laura C Guidotti
(74) *Attorney, Agent, or Firm* — Hill & Schumacher

(57) ABSTRACT

There is disclosed a floor squeegee for spreading resin on floors or removing liquid spills or debris from floors and other flat surfaces. The squeegee includes a frame section, a handle connected to the frame section such that the frame section is generally perpendicular to handle, the frame section including a preset number of internally threaded locator bosses. A flexible squeegee blade section includes a preset number of boss holes extending therethrough to receive the preset number of internally threaded locator bosses. The flexible squeegee blade section has a first section and a second section being integrally formed with the first elongate section and being inclined at an angle with respect to the first section in a range from about 0 to about 90°. The squeegee includes a clamp section having a preset number of boss holes extending therethrough to receive the preset number of internally threaded locator bosses, and a preset number of threaded nuts with the preset number of threaded nuts being threaded to be threadably received in the internally threaded locator bosses. When assembled the (Continued)

second blade section contacts a floor or other surface when in operation.

11 Claims, 3 Drawing Sheets

(58) Field of Classification Search
USPC ..... 15/245, 245.1; D32/41
See application file for complete search history.

(56) References Cited

U.S. PATENT DOCUMENTS

| | | | | |
|---|---|---|---|---|
| 4,240,176 | A | 12/1980 | Farmer | |
| 5,067,197 | A | 11/1991 | Cormier | |
| 6,243,911 | B1 * | 6/2001 | Varner | A47L 1/06 15/245 |

OTHER PUBLICATIONS

International Search Report, PCT/CA2016/051425, dated Mar. 27, 2017, 3 pages.
Written Opinion, PCT/CA2016/051425, dated Mar. 27, 2017, 4 pages.

* cited by examiner

FLOOR SQUEEGEE

FIELD

The present disclosure relates to a floor squeegee for spreading resin on floors or removing liquid spills or debris from floors and other flat surfaces.

BACKGROUND

Floor squeegees currently in use for spreading resin suffer from several drawbacks. These include the resinous materials hardening on the exposed fasters, the ends of the fastener nuts holding the squeegee components together which in turn makes it very difficult to remove and/or change the blades of the flexible squeegee section. Further, having the angle in the squeegee frame as oppose to the squeegee blade, which is typical with current floor squeegees, puts the fastener nuts in closer proximity to the resinous materials being applied. In addition, current floor squeegee frames do not have boss holes for easy alignment of the flexible squeegee blade.

SUMMARY

The present disclosure provides a floor squeegee, comprising:

an elongate frame section 8, an elongate handle 2 connected to said elongate frame section 8 such that said elongate frame section 8 is generally perpendicular to said elongate handle 2, said elongate frame section 8 including a preset number of internally threaded locator bosses 22;

an elongate flexible squeegee blade section 10 including a preset number of boss holes 20 extending therethrough to receive said preset number of internally threaded locator bosses 22, said elongate flexible squeegee blade section 10 having a first elongate section 10*a* and a second elongate section 10*b* being integrally formed with said first elongate section 10*a* and inclined at an angle with respect to said first elongate section 10*a* in a range from about 0 to about 90°; and an elongate clamp section 12 having a preset number of boss holes 16 extending therethrough to receive said preset number of internally threaded locator bosses 22, and a preset number of threaded nuts 14, said preset number of threaded nuts 14 being threaded to be threadably received in said internally threaded locator bosses 22, wherein when assembled said second elongate section 10*b* contacts a floor or other surface when in operation.

In an embodiment the preset number of internally threaded bosses 22, the preset number of boss holes 20 in said elongate flexible squeegee blade section 10 and the preset number of boss holes in the elongate clamp section 12 may be two or more. When assembled, the flexible squeegee blade section 10 is sandwiched between the elongate frame section 8 and the elongate clamp section 12 with two ore more internally threaded locator boss 22 being received through said two or more boss 20 holes in said flexible squeegee blade section 10 and two or more boss holes 16 in the elongate clamp section 12, and wherein threaded ends of the two or more threaded nuts 14 are sealed internally in the elongate frame section 8 and not exposed.

In an embodiment the first elongate section 10*a* and said second elongate section 10*b* may be inclined at an angle with respect to each in a range from about 30 to about 60°.

Alternatively, the first elongate section 10*a* and the second elongate section 10*b* may inclined at an angle with respect to each of about 45°.

In an embodiment the elongate frame section 8 and the elongate clamp section 12 may made from a plastic material. In this embodiment this plastic material may be polypropylene.

In an embodiment all edges and corners on the elongate frame section 8 and the elongate clamp section 12 may be radiused or rounded making it easier for the removal of cured coatings or debris.

In an embodiments the elongate flexible squeegee blade section 10 may be made from any one or combination of neoprene, silicone, urethanes and ethylene propylene diene monomer (M-class) rubber (EPDM rubber.

In an embodiment the elongate flexible squeegee blade section 10 may be made from any one or combination of one or more durometers.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which.

DETAILED DESCRIPTION

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately", when used in conjunction with ranges of dimensions of particles, compositions of mixtures or other physical properties or characteristics, are meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present disclosure.

Figure 1:
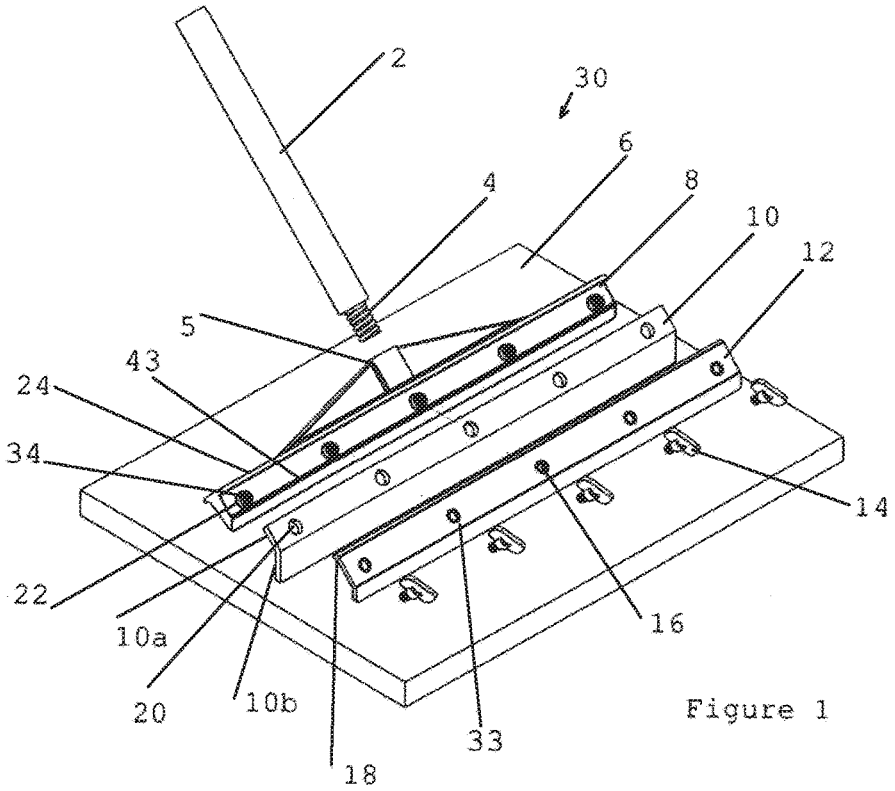
FIG. 1 is a perspective view of the present squeegee device disassembled.

FIG. 1 is a perspective view of the present squeegee device shown generally at 30 located above a floor surface 6 which is shown disassembled and which includes an elongate handle 2 having a threaded end portion 4. Elongate angle 2 may be a wooden, metal or plastic handle. Squeegee 30 includes an elongate frame 8 which includes a threaded receptacle 5 to receive therein threaded end portion 4 of handle 2. Elongate frame 8 includes at least one internally threaded locator boss 22, with five (5) internally threaded locator bosses 22 being shown in FIG. 1, which are spaced along the length of elongate frame 8 and project outwardly from the frame 8. An elongate, flexible rubber squeegee blade 10 having the same approximate length as elongate frame 8 includes at least one hole 20, with five (5) holes 20 shown in FIG. 1 having a diameter large enough to receive the locator bosses 22 when squeegee blade 10 is assembled with frame 8. Frame 8 and clamp 12 may be made from polypropylene or a variation of other plastic materials, which in turn makes it difficult for any cured floor coatings to bond to the frame 8 or clamp 12. In addition, all edges and corners on the frame 8 and clamp 12 are radiused or rounded thereby making it easier for the removal of cured coatings or debris. Rubber squeegee 10 is produced with two sections 10*a* and 10*b* at an angle of about 45°. However it will be appreciated that the angle between sections 10*a* and 10*b* may vary in a range from about 0 to about 90°.

Rubber squeegee blade 10 may be made from different rubbers including EPDM, neoprene, silicone or urethanes or any combination thereof. The squeegee blade 10 may also be comprised of different durometers or a combination of different durometers in the same squeegee blade 10.

Squeegee 30 includes a clamp member 12 which includes at least one locator hole 16, with five (5) locator holes 16 shown in FIG. 1 which are designed to align with holes 20 in rubber squeegee 10 and locator bosses 22 on frame 8 when the squeegee 30 is assembled. At least one thumb screw 14, with five thumb screws 14 being shown in FIG. 1, are spaced along clamp section 12 and when assembled the thumb screws 14 are passed through holes 16 in clamp section 12 and through holes 20 in the rubber squeegee 10 and then threaded into threaded boss holes 22 when the squeegee device 30 is assembled.

Figure 2:
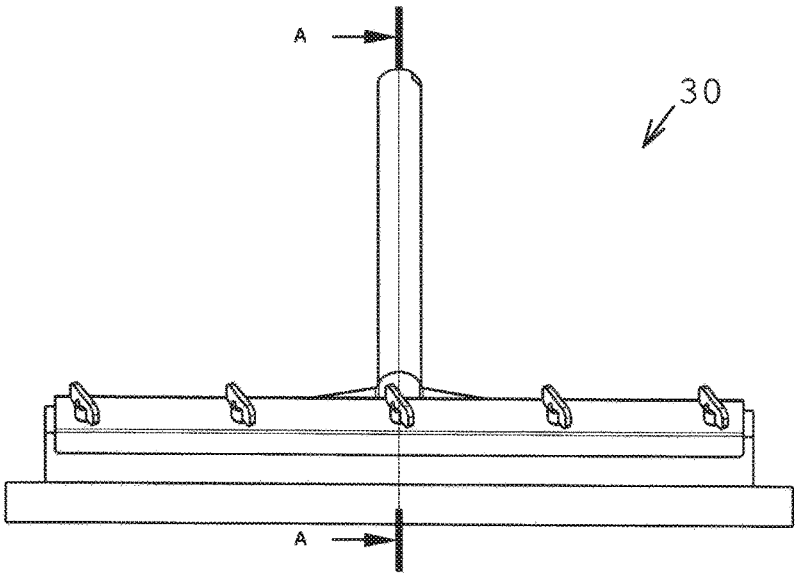
FIG. 2 is an elevation view of the squeegee looking from the front of the squeegee.
Figure 3:
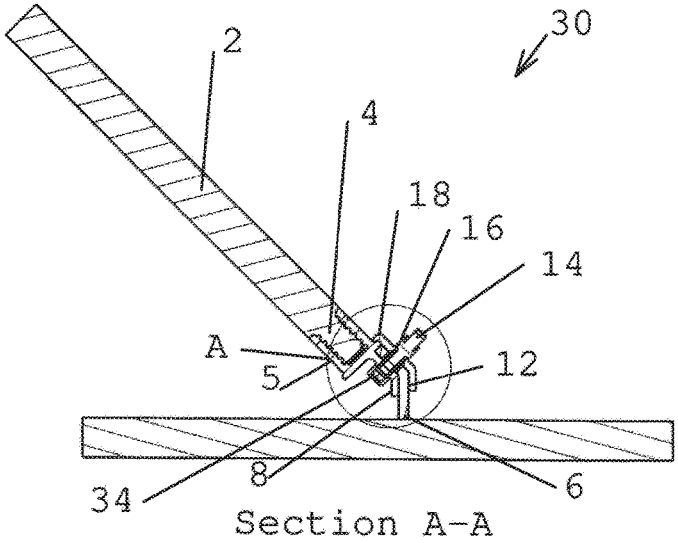
FIG. 3 is a sectional view of the squeegee of FIG. 2 taken along the line A-A.
Figure 4:
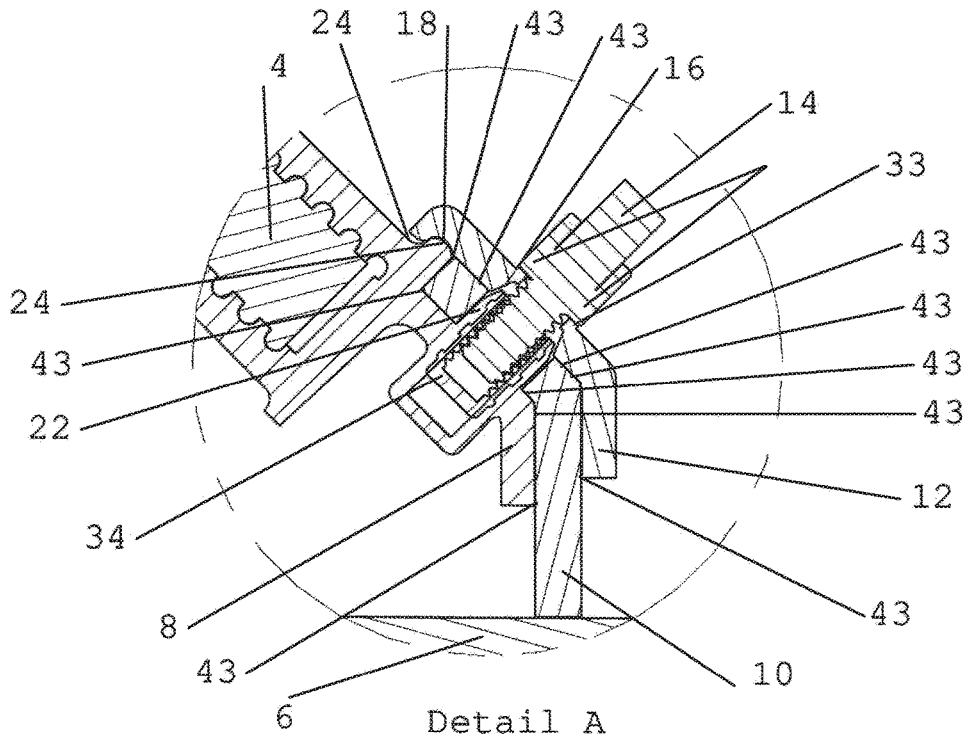
FIG. 4 is a blow-up of the circled section A in FIG. 3.

FIG. 2 is an elevation view of the squeegee looking from the front of the squeegee, and FIG. 3 is a sectional view of the squeegee of FIG. 2 taken along the line A-A. FIG. 4 is a blow-up of the circled section A in FIG. 3 and as can be seen, clamp section 12 includes a curved peripheral edge 18 which mates with the curved surface 24 on the peripheral edge on frame 8. The threaded ends of nuts 14 are totally enclosed within the threaded bosses 22.

FIGS. 1, 3 and 4 show a raised lip 33 peripherally disposed around locator hole 16 which is included to prevent material from potentially bonding fastener 14 to clamp 12. FIG. 4 shows a non-threaded end of the threaded fastener or nut 14, where a flange 35 of the non-threaded end of the threaded nut 14 contacts the raised lip 33 when fully threaded into the boss holes 22 and has an outer diameter which is greater than an outer diameter of the raised lip 33. The greater outer diameter of the flange 35 compared to the threaded nut 14 is advantageous as it prevents seepage of the liquid being spread by the squeegee into the internally threaded locator boss 22. FIGS. 1, 3 and 4 show raised areas 43 close to the perimeters of both the elongate frame 8 and the elongate clamp 12 which assist in holding the squeegee blade 10 in place and help to prevent seepage of material between the blade 10 and the clamp 12 or the frame 8. The internally threaded locator bosses 22 may include over-molded threaded inserts 34 which may be made of brass, to give one non-limiting example. The above noted features are very advantageous in that when the squeegee 30 is fully assembled and used in the spreading of floor coatings, the coating material will not interfere or come in contact with the threads of the fasteners 14 which provides for easier changing of the squeegee blades 10.

The present squeegee may be produced with different lengths of the frame 8, flexible squeegee section 10 and clamp section 12, depending on the application for which the squeegee is intended. For example a hand held version may be produced which may be a few inches long for use in restricted spaces, or longer versions of a couple of feet long may be used for applications where large surface areas are being coated.

The squeegee disclosed herein is very advantageous over conventional squeegees for the following reasons. Since the threaded ends of the fastening nuts are sealed inside the frame 8, the resinous materials be spread by the squeegee will not hinder the fastening nuts 14 as they are internal threads and blind holes with no exposure to the resinous materials. In addition, in the case of an angle greater that 0° between the squeegee sections 10*a* and 10*b*, the flexible squeegee blade has been angled as opposes to the squeegee frame having a built in angle which keeps the fasteners 14 further away and at an upward angle from the resinous materials. Further, the present squeegee 30 has internally threaded bosses 22 and corresponding holes 22 in the flexible squeegee and corresponding holes in flexible squeegee section 10 so that all the components are forced into perfect when the squeegee is assembled.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A squeegee, comprising:

an elongate frame section, an elongate handle connected to said elongate frame section such that said elongate frame section is generally perpendicular to said elongate handle, said elongate frame section including a preset number of internally threaded blind locator holes each having a raised boss;

an elongate flexible squeegee blade section including a first elongate section and a preset number of locator holes each extending therethrough to receive a corresponding raised boss of said elongate frame section, said elongate flexible squeegee blade section including a second elongate section protruding from and being integrally formed with said first elongate section and inclined at an angle with respect to said first elongate section in a range from greater than 0° to less than 90°;

an elongate clamp section having a preset number of locator holes each extending therethrough to receive, a corresponding raised boss of said elongate frame section and further comprising a raised lip disposed around each of said preset number of locator holes and a preset number of threaded fasteners, each of said preset number of threaded fasteners being threaded to be threadably received in an associated internally threaded blind locator hole and each threaded fastener including a flange section configured to contact said raised lip;

wherein threaded sections of each of said threaded fasteners are sealed internally in an associated internally threaded blind locator hole and are not exposed when the squeegee is assembled; and wherein when assembled said second elongate section contacts a floor or other surface when in operation.

2. The squeegee according to claim 1 wherein said preset number of internally threaded blind locator holes, said preset number of locator holes in said elongate flexible squeegee blade section and said preset number of locator holes in said elongate clamp section are two or more, and wherein, when assembled, said flexible squeegee blade section is sandwiched between said elongate frame section and said elongate clamp section with said two or more internally threaded locator boss being received through said two or more boss holes in said flexible squeegee blade section and two or more boss hole in said elongate clamp section.

3. The squeegee according to claim 1 wherein said first elongate section and said second elongate section are inclined at an angle with respect to each in a range from about 30 to about 60°.

4. The squeegee according to claim 1 wherein said first elongate section and said second elongate section are inclined at an angle with respect to each of about 45°.

5. The squeegee according to claim 1 wherein said elongate frame section and said elongate clamp section are made from a plastic material.

6. The squeegee according to claim 5 wherein said plastic material is polypropylene.

7. The squeegee according to claim 1 wherein all edges and corners on said elongate frame section and said elongate clamp section are radiused or rounded making it easier for the removal of cured coatings or debris.

8. The squeegee according to claim 1 wherein said elongate flexible squeegee blade section is made from any one or combination of neoprene, silicone, urethanes and ethylene propylene diene monomer (M-class) rubber (EPDM rubber).

9. The squeegee according to claim 1 wherein said elongate flexible squeegee blade section is made from any one or combination of one or more materials having different hardness.

10. The squeegee according to claim 1 wherein each flange section of each fastener has an outer diameter which is greater than an outer diameter of the raised lip of the elongate clamp section that the flange section is in contact with.

11. The squeegee according to claim 1 wherein said elongate frame section and said elongate clamp section are made from a flexible material making it easier for the removal of cured coatings or debris.

* * * * *